US007721501B2

(12) United States Patent
Lynch et al.

(10) Patent No.: US 7,721,501 B2
(45) Date of Patent: May 25, 2010

(54) DOOR WITH GLASS INSERT AND METHOD FOR ASSEMBLING THE SAME

(75) Inventors: Steven Lynch, St. Charles, IL (US); Jason Caulk, St. Charles, IL (US); Jason M. Walsh, Batavia, IL (US); Mark A. Ruggle, Franklin Park, IL (US); Timothy D. Gouge, Elgin, IL (US); Gary Thomas Fagan, Huntersville, NC (US); Eric Duane Bennett, Huntersville, NC (US); Haritha Wunnava, Charlotte, NC (US); Danny Lee Fitts, Bonaqua, TN (US)

(73) Assignee: Masonite Corporation, Tampa, FL (US)

( * ) Notice: Subject to any disclaimer, the term of this patent is extended or adjusted under 35 U.S.C. 154(b) by 209 days.

(21) Appl. No.: 11/714,281

(22) Filed: Mar. 6, 2007

(65) Prior Publication Data

US 2007/0204546 A1 Sep. 6, 2007

Related U.S. Application Data

(60) Provisional application No. 60/778,974, filed on Mar. 6, 2006.

(51) Int. Cl.
*E06B 3/58* (2006.01)

(52) U.S. Cl. ..... 52/456; 52/455; 52/784.1; 52/794.1; 52/309.9

(58) Field of Classification Search ..... 52/455, 52/456, 784.1, 784.13, 792.1, 792.11, 208, 52/794.1, 309.9, 784.15; 49/501
See application file for complete search history.

(56) References Cited

U.S. PATENT DOCUMENTS 1,171,443 A * 2/1916 Larson ..... 52/800.16
3,641,721 A * 2/1972 Martin ..... 52/212
3,903,669 A * 9/1975 Pease et al. ..... 52/455
4,897,975 A * 2/1990 Artwick et al. ..... 52/208
4,920,718 A * 5/1990 Artwick et al. ..... 52/476
4,947,597 A * 8/1990 Simpson ..... 52/208
4,977,722 A * 12/1990 Taylor ..... 52/730.3
5,018,330 A * 5/1991 Lewkowitz ..... 52/455

(Continued)

FOREIGN PATENT DOCUMENTS

EP 1 094 192 4/2001

(Continued)

*Primary Examiner*—Robert J Canfield
*Assistant Examiner*—Jessie Fonseca
(74) *Attorney, Agent, or Firm*—Berenato & White, LLC

(57) ABSTRACT

A door comprising first and second door skins secured to each other to form a cavity therebetween filled with expended foam. Each of the door skins has an opening therethrough for receiving a glass insert and a flange portion. Distal ends of the flange portions of the first and second door skins engage each other in an overlapping relationship by the expansion pressure of the expanded foam. The door further comprises a glazing rim member having a leg portion snap-locked between the flange portions of the first and second door skins. The method for assembling the door comprises the steps of filling the cavity between the door skins with foam material, then inserting the glass insert through the openings in the door skins and mounting the glazing rim member to the first door skin by snap-locking between the flange portions of the first and second door skins.

23 Claims, 7 Drawing Sheets

U.S. PATENT DOCUMENTS

| | | | | | |
|---|---|---|---|---|---|
| 5,105,597 | A * | 4/1992 | Wilkening | 52/455 |
| 5,325,648 | A * | 7/1994 | Menard | 52/456 |
| 5,544,454 | A * | 8/1996 | Richardson et al. | 52/171.1 |
| 5,557,899 | A * | 9/1996 | Dube et al. | 52/455 |
| 5,603,585 | A * | 2/1997 | Bruchu et al. | 403/382 |
| 5,765,325 | A * | 6/1998 | DeBlock | 52/204.5 |
| 5,837,095 | A * | 11/1998 | Bruchu et al. | 156/499 |
| 6,151,849 | A * | 11/2000 | Twigg et al. | 52/208 |
| 6,161,363 | A * | 12/2000 | Herbst | 52/784.15 |
| 6,311,454 | B1 * | 11/2001 | Kempel | 52/784.15 |
| 6,318,037 | B1 * | 11/2001 | Hansen | 52/208 |
| 6,546,682 | B1 * | 4/2003 | DeBlock et al. | 52/204.72 |
| 6,574,935 | B2 * | 6/2003 | Wang Chen | 52/455 |
| 6,619,005 | B1 * | 9/2003 | Chen | 52/455 |
| 6,688,064 | B1 * | 2/2004 | Swanick | 52/455 |
| 6,729,095 | B2 * | 5/2004 | Wang Chen | 52/456 |
| 6,931,810 | B2 * | 8/2005 | Beaudoin et al. | 52/455 |
| 2002/0092254 | A1 | 7/2002 | Wang Chen | |
| 2004/0144046 | A1 * | 7/2004 | Wang et al. | 52/204.1 |

FOREIGN PATENT DOCUMENTS

| | | |
|---|---|---|
| GB | 2 377 470 | 1/2003 |

* cited by examiner

DOOR WITH GLASS INSERT AND METHOD FOR ASSEMBLING THE SAME

CROSS-REFERENCE(S) TO RELATED APPLICATION(S) AND CLAIM TO PRIORITY

This application claims the benefit of priority under 35 U.S.C. 119(e) from U.S. provisional patent application 60/778,974, which was filed on Mar. 6, 2006, the disclosure of which is incorporated herein in its entirety.

FIELD OF THE INVENTION

The present invention relates generally to door assemblies in general, and, more particularly, to a door having a glass insert and a method for assembling the same.

BACKGROUND OF THE INVENTION

A commonplace substitution for the traditional wooden doors in residential and commercial buildings is a door made from steel or fiberglass. One type of synthetic door is formed with resin sheets reinforced with fiber glass (in the art referred to as door skins) attached to opposite sides of rails and stiles forming a rectangular frame, with the resulting cavity between the door skins filled with a polymer foam material. Doors so constructed can include wood graining on the outer surfaces of the skins, and also raised paneling formed (molded) in the skins, which gives these doors the appearance of natural wood fabricated products.

Molded skins for making such doors are typically formed using mixtures having by weight 12% to 15% polyester resin, 5% to 15% polystyrene, 40% to 50% calcium carbonate and 15% to 25% chopped fiberglass. Such mixtures are deposited in a compression molding machine and subjected to pressures from 600 to 1,500 psi and elevated temperatures for a cure cycle of from 60 to 200 seconds to form rigid skins. The mixture described is one of those known as a "sheet molding compound" (SMC).

The door skins formed from SMC processes for doors can have thicknesses of from about 0.13 mm (0.05 inches) to about 52 mm (0.20 inches), depending on the door application in which they are used.

As previously noted such skins are affixed to opposite sides of a rectangular frame and the core (cavity) enclosed by the frame and skins is tilled with polymer foam to complete the door. A rigid urethane foam having a density of 0.8 pounds per cubic foot to 3.5 pounds per cubic foot is suitable for the core of such doors.

Previously, these doors may have had glass inserts (glazing or lights) that covered less than 30% of the door's exterior surface. Currently the marketplace demands doors with larger glass inserts, which can comprise more than 60% of the door's exterior surface. Due to building codes, these large glass inserts must be double glazed (double pane) and in some cases made of safety glass. While known doors with glass inserts have proven to be acceptable for various applications, such doors are nevertheless susceptible to improvements that may enhance their performance and lower cost. With this in mind, a need exists to develop improved doors with glass inserts that advance the art.

SUMMARY OF THE INVENTION

The present invention provides an improved door having a large central glass insert and a method for assembling the same. Alternatively, the invention is an improved building component having a lite, such as a door, a side lite, or a transom lite.

According to a first aspect of the present invention, a door is provided. The door features a glass insert having opposite first and second major surfaces and an outer edge extending between the first and second major surfaces, a first door skin having a first opening receiving the glass insert, a second door skin having a second opening aligned with the first opening for receiving the glass insert, a glazing rim member, and a core material disposed in a core cavity between the first and second door skins. The first door skin includes a first planar portion, a first flange portion at the first opening extending from the first planar portion substantially parallel to the outer edge of the glass insert, and a first lip portion extending the first opening to contact the first major surface of the glass insert. The second door skin includes a second planar portion that is spaced from the first planar portion to form the core cavity between the first and second planar portions, a second flange portion at the second opening extending from the second planar portion substantially parallel to the outer edge of the glass insert to contact the first flange portion, and a guide wall comprising a guide rim. The guide wall has an exterior surface generally facing away from the first door skin and angularly disposed relative to the second planar portion and the second flange portion. The glazing rim member includes a second lip portion contacting the second major surface of the glass insert, a leg portion disposed on a surface of the second flange portion, and a skirt portion. The leg portion includes a distal end and an opposite pilot edge. The distal end is interlockingly engaged between a glazing rim locking tab of the first door skin and the second flange portion and the pilot edge is engaged to the guide rim to interference fit the glazing rim member to the second door skin and the glass insert. The skirt portion is spaced from the pilot edge to define a pilot cavity that receives the guide rim, and applies contact pressure to the exterior surface of the guide wall.

According to a second aspect of the invention, a pre-assembled door is provided for receiving a glass insert having opposite first and second major surfaces and an outer edge extending between the first and second major surfaces. The pre-assembled door features a first door skin having a first opening for receiving the glass insert, a second door skin having a second opening that when in a door assembled state is aligned with the first opening for receiving the glass insert, and a glazing rim member. The first door skin includes a first planar portion, a first flange portion at the first opening extending from the first planar portion, and a first lip portion extending into the first opening for contacting the first major surface of the glass insert. The second door skin includes a second planar portion that when in the door assembled state is spaced from the first planar portion to form a core cavity between the first and second planar portions, a second flange portion at the second opening extending from the second planar portion for contacting the first flange portion, and a guide wall including a guide rim. The guide wall has an exterior surface generally facing away from the first door skin when in the door assembled state and angularly disposed relative to the second planar portion and the second flange portion. The glazing rim member includes a second lip portion, a leg portion having a distal end and an opposite pilot edge, and a skirt portion. When in the door assembled state, the second lip portion contacts the second major surface of the glass insert, the leg portion is disposed on a surface of the second flange portion, the distal end is interlockingly engaged between a glazing rim locking tab of the first door skin and the second flange portion, the pilot edge engages the guide rim to interference fit the glazing rim member to the second door skin and the glass insert, the skirt portion is spaced from the pilot edge to define a pilot cavity that receives the guide rim, and the skirt portion applies contact pressure to the exterior surface of the guide wall.

According to a third aspect of the present invention, a building component is provided. The building structure features a glass insert having opposite first and second major surfaces and an outer edge extending between the first and second major surfaces, a first building component skin having a first opening receiving the glass insert, a second building component skin having a second opening aligned with the first opening for receiving the glass insert, a glazing rim member, and a core material disposed in a core cavity between the first and second building component skins. The first building component skin includes a first planar portion, a first flange portion at the first opening extending from the first planar portion substantially parallel to the outer edge of the glass insert, and a first lip portion extending into the first opening to contact the first major surface of the glass insert. The second building component skin includes a second planar portion that is spaced from the first planar portion to form the core cavity between the first and second planar portions, a second flange portion at the second opening extending from the second planar portion substantially parallel to the outer edge of the glass insert to contact the first flange portion, and a guide wall comprising a guide rim. The guide wall has an exterior surface generally facing away from the first building component skin and angularly disposed relative to the second planar portion and the second flange portion. The glazing rim member includes a second lip portion contacting the second major surface of the glass insert, a leg portion disposed on a surface of the second flange portion, and a skirt portion. The leg portion includes a distal end and an opposite pilot edge. The distal end is interlockingly engaged between a glazing rim locking tab of the first building component skin and the second flange portion and the pilot edge is engaged to the guide rim to interference fit the glazing rim member to the second building component skin and the glass insert. The skirt portion is spaced from the pilot edge to define a pilot cavity that receives the guide rim, and applies contact pressure to the exterior surface of the guide wall.

According to a fourth aspect of the invention, a method for assembling a door is provided. The method involves mounting a glazing rim member on a partially constructed door. The partially constructed door includes a glass insert having opposite first and second major surfaces and an outer edge extending between the first and second major surfaces, a first door skin having a first opening receiving the glass insert, and a second door skin having a second opening aligned with the first opening for receiving the glass insert. The first door skin includes a first planar portion, a first flange portion at the first opening extending from the first planar portion substantially parallel to the outer edge of the glass insert, and a first lip portion extending into the first opening to contact the first major surface of the glass insert. The second door skin includes a second planar portion that is spaced from the first planar portion to form a core cavity between the first and second planar portions, a second flange portion at the second opening extending from the second planar portion substantially parallel to the outer edge of the glass insert to contact the first flange portion, and a guide wall including a guide rim. The guide wall has an exterior surface generally facing away from the first door skin and angularly disposed relative to the second planar portion and the second flange portion. When mounted, the glazing rim member includes a second lip portion contacting the second major surface of the glass insert, a leg portion disposed on a surface of the second flange portion, and a skirt portion. The leg portion includes a distal end and an opposite pilot edge. The distal end interlockingly engages between a glazing rim locking tab of the first door skin and the second flange portion, and the pilot edge engages the guide rim to interference fit the glazing rim member to the second door skin and the glass insert. The skirt portion is spaced from the pilot edge to define a pilot cavity that receives the guide rim, and applies contact pressure to the exterior surface of the guide wall.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENT(S)

The preferred embodiment of the present invention will now be described with the reference to accompanying drawings.

Figure 1:
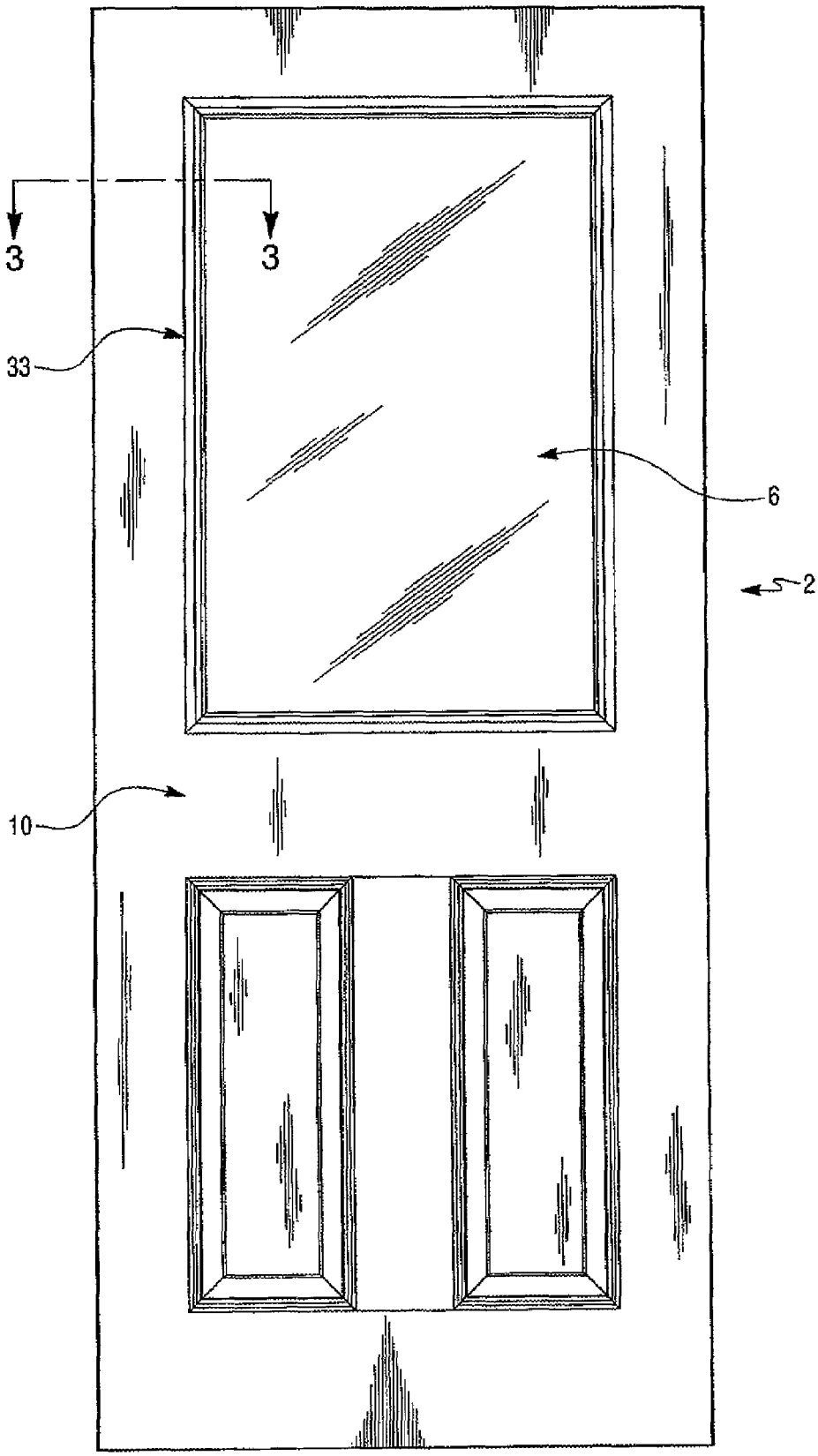
FIG. 1 is a plan view of a door of the present invention.
Figure 2A:
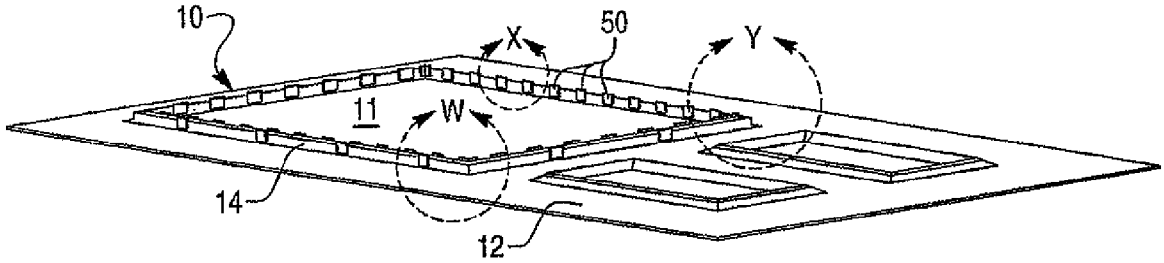
FIG. 2A is a perspective view of an inner surface of a first door skin according to the preferred embodiment of the present invention.
Figure 3:
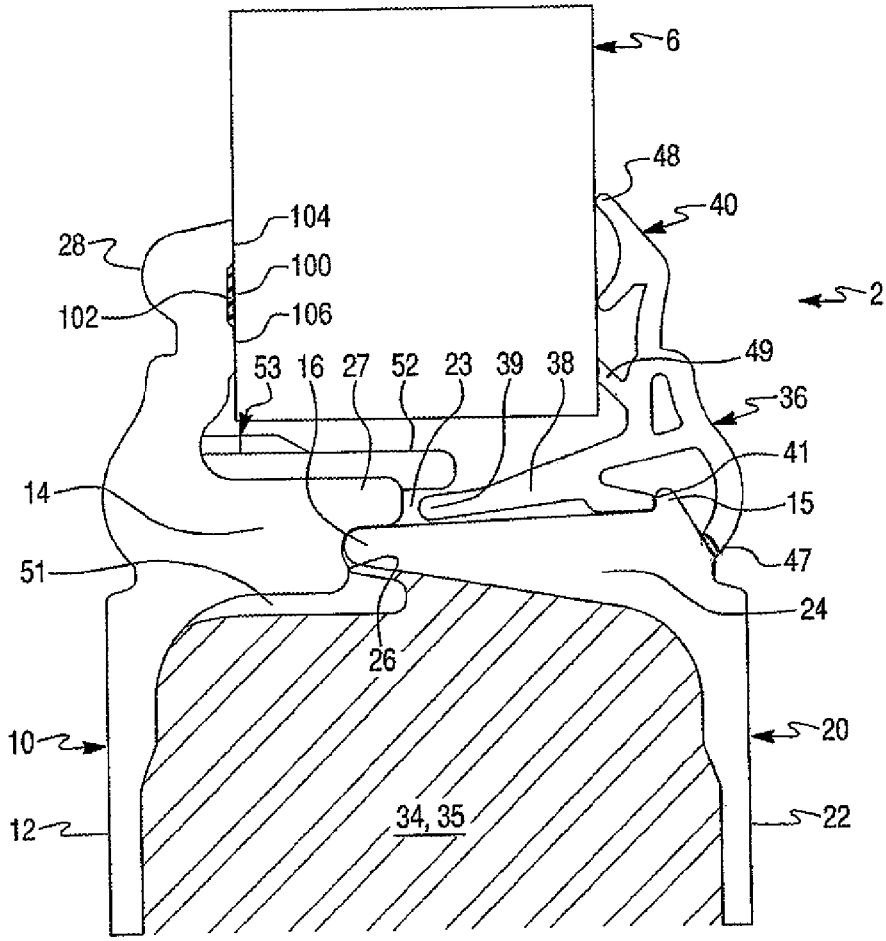
FIG. 3 is a fragmentary cross-sectional view of the door in FIG. 1 according to the preferred embodiment of the present invention.
Figure 2B:
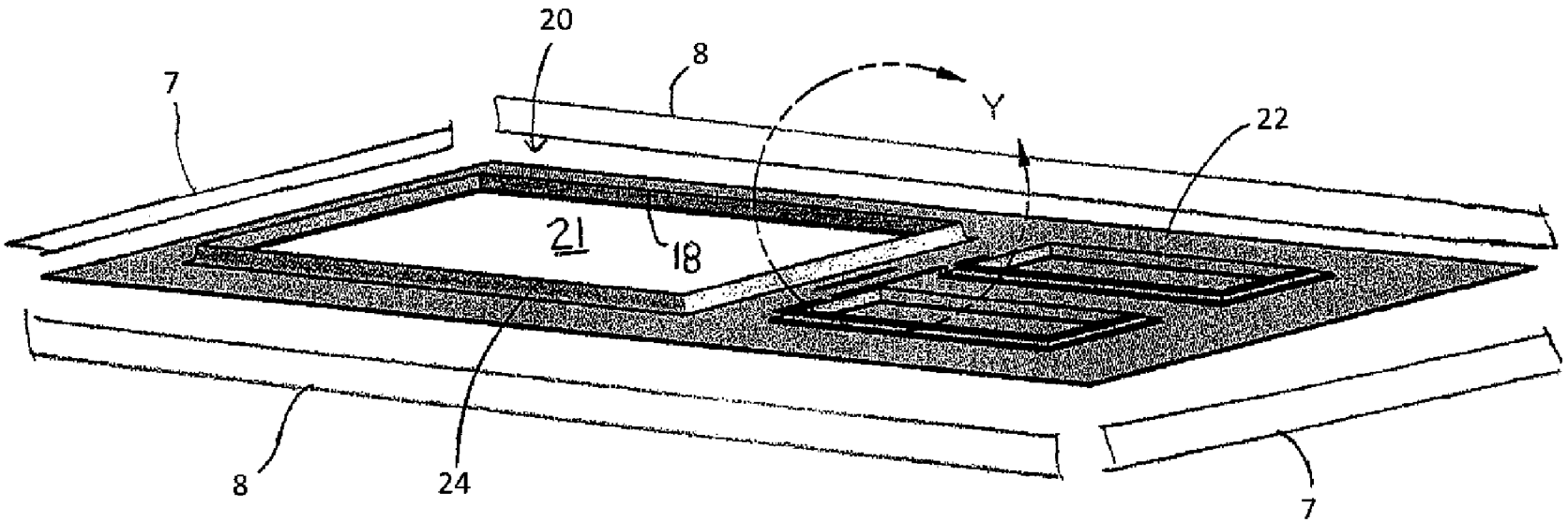
FIG. 2B is an exploded perspective view of an inner surface of a second door skin according to the preferred embodiment of the present invention.

FIG. 1 illustrates a door of the present invention indicated generally by reference numeral 2. The door 2 being formed from fiberglass reinforced SMC door skins 10 and 20, as best shown in FIGS. 2A and 2B. The door 2 is provided with a preferably rectangular opening for receiving a glass insert (or panel) 6. As best shown in FIGS. 2A, 2B, and 3, the door 2 comprises first and second door skins 10 and 20, respectively, top and bottom rails 7, and left and right stiles 8. The first door skin 10 and the second door skin 20 may correspond to an exterior door skin and an interior door skin, respectively. The first and second door skins 10 and 20 are secured to each other through the top and bottom rails 7 and the left and right stiles 8, typically secured with adhesive, such as moisture cured urethane adhesive, to the door skins 10, 20, and forming a rectangular door frame. Referring now to FIG. 3, the first and second door skins 10 and 20 are so secured to the frame to form a cavity 34 therebetween. The cavity 34 of the door 2 is filled with an expanded foam insulating material 35 defining an insulating core 35 of the door 2.

Preferably, the first and second door skins 10 and 20 are molded from an appropriate polymer material and have a thickness of about 1 to 4 mm. The material of the door skins 10 and 20 of the present invention can be sheet molding compound (SMC) reinforced with fiber glass, wood fiber, steel or wood. Preferably, the door skins 10 and 20 are molded and can be made from such materials as fiberglass reinforced plastics, pressed board, vinyl esters, polystyrenes or other moldable materials. An outer surface of the door skins 10 or 20 can be smooth without wood grain or can have a simulated wood grain. The depth of the wood grain is about 0.05 to 0.2 mm. An inner surface of the door skins may have a relatively rough surface to increase the surface area for the adhesive when the door is assembled. This results in stronger bonds between the door skins, the foam material, the rails and the stiles.

As best shown in FIGS. 2A and 2B, each of the first and second door skins 10 and 20 is provided with an opening therethrough for receiving the glass insert 6. More specifically, the first door skin 10 has an opening 11 therethrough, while the second door skin 10 has an opening 21 therethrough. While we prefer that the openings 11, 21 be rectangular, they can have any configuration, provided that they are complementary. As shown in FIGS. 2A and 2B, the first and second door skins 10 and 20 include respective integral flange portions 14 and 24 that extend inward into the cavity 34 (see FIG. 3) and define the respective openings 11 and 21.

As best shown in FIGS. 2A and 3, the first door skin 10 includes a plurality of tabs 50 for positioning the flange portion 24 of the second door skin 20, the glass insert 6, and a glazing rim member 36.

Figure 4:
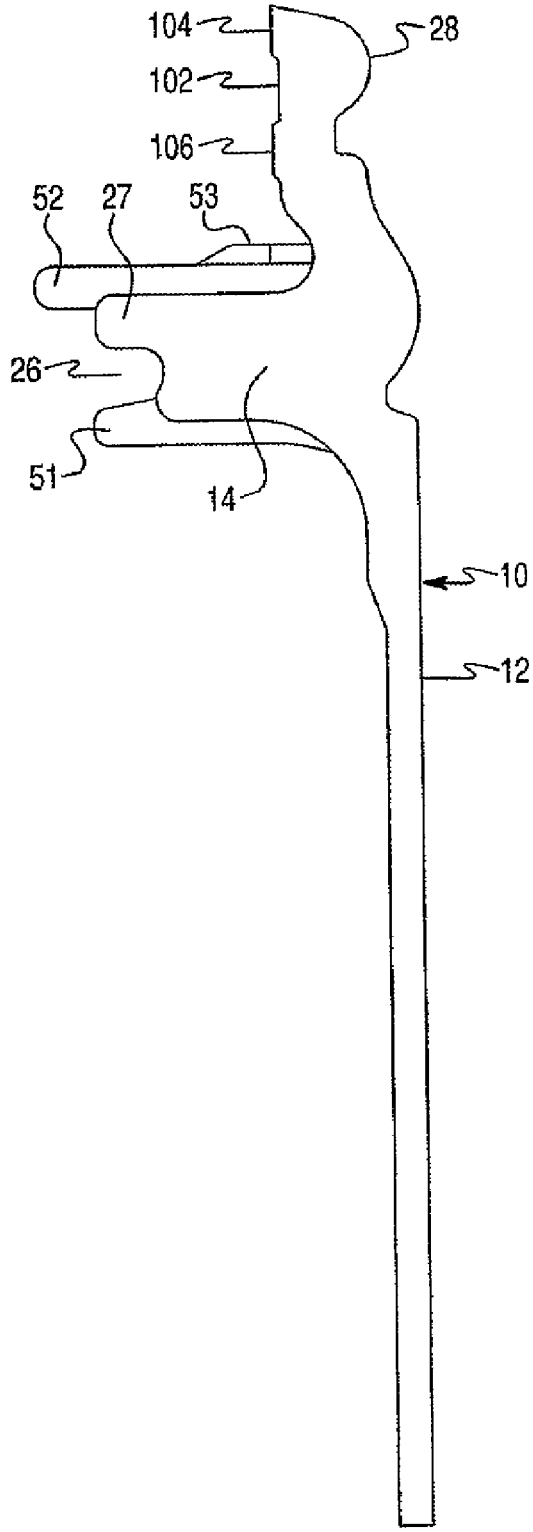
FIG. 4 is a fragmentary cross-sectional view of the first door skin of FIG. 2A according to the preferred embodiment of the present invention.

The first door skin 10, as illustrated in FIG. 4, includes a substantially planar plate portion 12 formed with the opening 11 (see FIG. 2A) therethrough for mounting the glass insert 6, and the flange portion 14 formed integrally with the planar plate portion 12 and extending substantially inwardly therefrom toward the second door skin 20, as shown in FIG. 3. Preferably, the flange portion 14 extends substantially normal to the planar plate portion 12 of the first door skin 10. The first door skin 10 further includes a lip portion 28 extending upwardly from the flange portion 14 and inwardly at its distal end to support the glass insert 6 positioned within the opening 11 of the first door skin 10. According to the preferred embodiment of the present invention, the first door skin 10 is molded from an appropriate polymer material as a single-piece part.

Furthermore, the flange portion 14 of the first door skin 10 includes a distal end 27 with a first notch 26. The first notch 26 has a geometry configured to mate with a distal end 16 of the flange portion 24 of the second door skin 20 (as shown in FIG. 3).

As mentioned above, the first door skin 10 includes the plurality of positioning tabs 50 shown in FIG. 2A. As shown in FIGS. 3 and 4, the tabs 50 are spread along flange portion 14 and include a plurality of skin positioning tabs 51 extending below the flange portion 14, a plurality of glazing rim locking tabs 52-extending above the flange portion 14, and a plurality of glass insert positioning tabs 53 extending above the glazing rim locking tabs 52.

Figure 5:
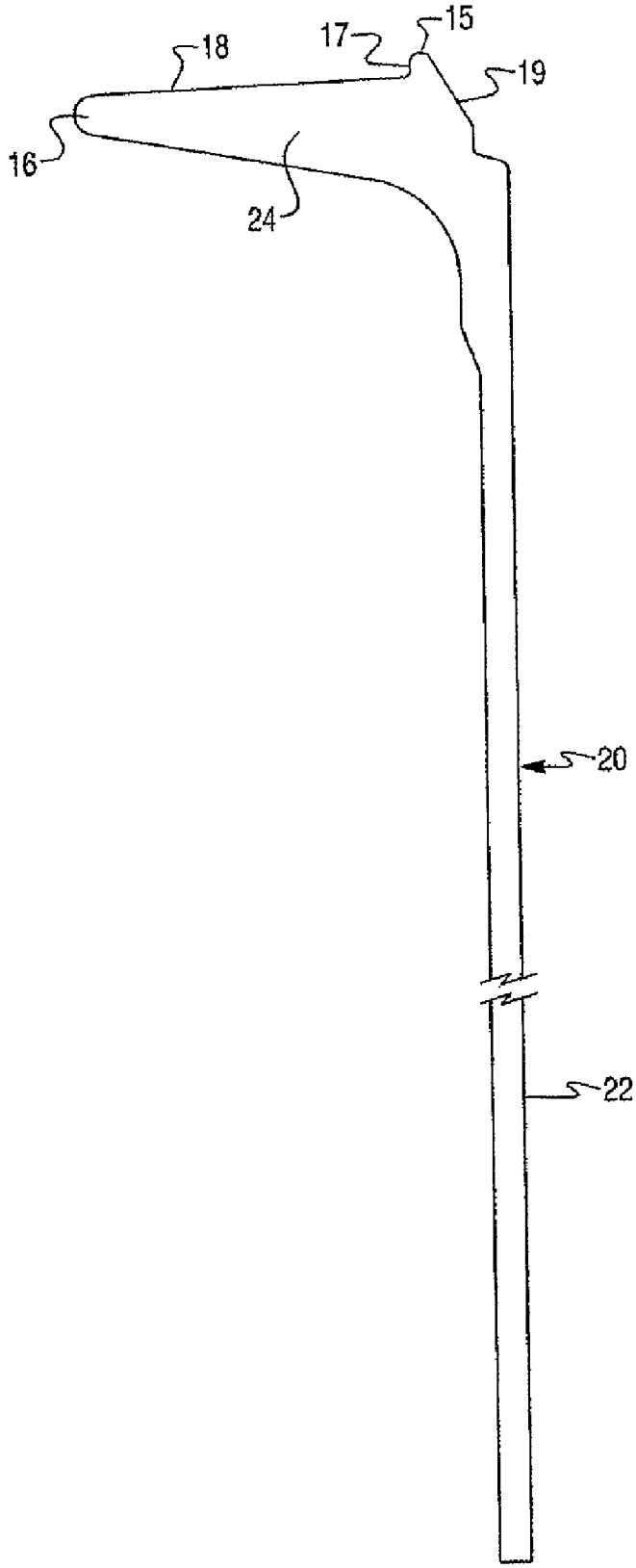
FIG. 5 is a fragmentary cross-sectional view of the second door skin of FIG. 2B according to the preferred embodiment of the present invention.

The second door skin 20, as illustrated in FIG. 5, includes a substantially planar plate portion 22 formed with the opening 21 (see FIG. 2B) therethrough for mounting the glass insert 6, the flange portion 24 formed integrally with the planar plate portion 22 and extending substantially inwardly therefrom toward the first door skin 10, as shown in FIG. 3. An outer peripheral preferably flat surface 18 of the flange portion 24 of the second door skin 20 defines the opening 21 (see FIG. 2B) therethrough, as best shown in FIG. 5. Preferably, the flange portion 24 extends substantially normal to the planar plate portion 22 of the second door skin 20.

Furthermore, as best shown in FIG. 5, the first door skin 20 has a guide rim 15 extending upwardly from the outer peripheral surface 18 of the flange portion 24. The guide rim 15 has a flat inner wall 17 spaced inwardly from and extending substantially parallel to the planar plate portion 22 and an outer wall 19 outwardly inclined relative to the plate portion 22 at an approximately 45° angle. It will be appreciated that any other appropriate angle of inclination of the outer wall 19 relative to the plate portion 22 is within the scope of the present invention. According to the preferred embodiment of the present invention, the second door skin 20 is molded from an appropriate polymer material as a single-piece part.

As best shown in FIG. 3, when the first and second door skins 10 and 20 are assembled together, the distal end 16 of the second flange portion 24 is positioned in the first notch 26 of the first flange portion 14 to form an interlocking joint. The first notch 26 extends the length of the first flange portion 14 and provides stability to the joint. The second flange portion 24 may have a length exceeding the length of the flange portion 14. Preferably, flange portion 24 extends approximately two thirds of the thickness of the cavity 34.

Although a small spacing is shown in FIG. 3 between the second skin positioning tab 51 and the distal end 16 of the second flange portion 24, these components may be shaped such that the distal end 16 of the flange portion 24 fits securely in the first notch 26 substantially without spacing. The first notch of the flange portion 24 cooperates to form a dam that prevents the expendable foam 35 from expanding into the area where the panel 6 is to be received.

Referring back to FIG. 1, the door 2 further comprises a rectangular glazing rim 33 provided for holding and locking the glass insert 6 in the opening of the door 2. The glazing rim 33 comprises four elongated glazing rim members 36 (shown in FIGS. 3 and 7) forming the rectangular glazing rim 33. Each of the glazing rim members 36, as best shown in FIG. 7, includes a leg portion 38 and a lip portion 40 formed integrally with the leg portion 38 and extending outwardly therefrom and having distal end 39.

Figure 7:
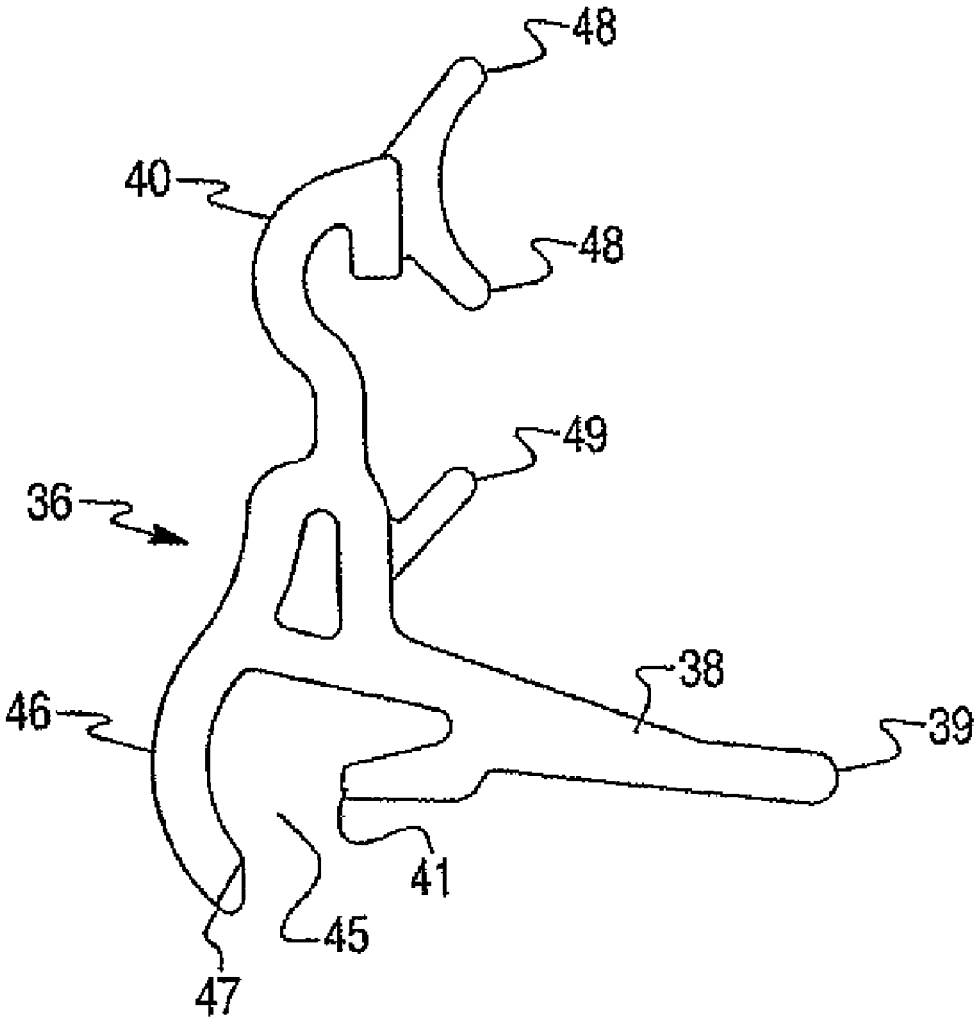
FIG. 7 is a fragmentary cross-sectional view of a glazing rim member according to the preferred embodiment of the present invention.

As shown in FIG. 7, the lip portion 40 of the glazing rim member 36 has a plurality of lip portion flexible sealant fins 48 extending inwardly therefrom to support the glass insert 6 positioned within the opening of the door 2 on the side opposite to the lip portion 28 of the first door skin 10. The lip portion flexible sealant fins 48 provide a contact force against the glass insert 6 so as to prevent rattling of the glass insert 6 within the door 2.

The glazing rim member 36 further includes a skirt portion 46 extending from the lip portion 40 and formed integrally therewith so as to form a pilot cavity 45 between the skirt portion 46 and a pilot edge 41 of the leg portion 38 of the glazing rim member 36. The pilot cavity 45 is provided for receiving the guide rim 15 of the second door skin 20 therein. As best shown in FIG. 7, a distal end 47 of the skirt portion 46 is a skirt portion flexible sealant fin 47 that applies contact pressure to the outer wall 19 of the second door skin 20 when the glazing rim member 36 is assembled therewith. The glazing rim member 36 further includes a midsection flexible sealant fin 49 disposed between the lip portion 40 and the leg portion 38.

The lip portion sealant fins 48, the midsection sealant fin 49, and the skirt portion sealant fin 47 allow the glazing rim member 36 to be interference fitted to the second door skin 20, the glass insert 6, and the glazing rim locking tabs 52. Each of the sealant fins 48, 49, and 47 is flexible so as to apply a contact force to the glass insert 6 and the second door skin 20 when assembled with the first and second door skins 10 and 20 and the glass insert 6. Since each of these sealant fins 47, 48, and 49 is pressed against a corresponding surface of the glass insert 6 or the second door skin 20, the friction that results from the contact pressure maintains the glazing rim member 36 in engagement with the insert 6. Accordingly, a tight seal is provided between an area on the glass insert 6 where the lip portion sealant fins 48 contact the glass insert 6 and the guide wall 19 of the second door skin 20.

Additionally, the sealant fins 48, 49, and 47 provide resistance to movement of the glass insert 6 within the opening in the door 2. As a result, the door 2 assembled from the first and second door skins 10 and 20, the glass insert 6, and the glazing rim member 36 is maintained in a stable state without shifting or movement of the components.

According to the preferred embodiment of the present invention, the glazing rim member 36 is coextruded from appropriate polymer materials as a single-piece part, which may then be cut to length and mitred to provide the individual glazing rim frame members 36 with the sealant fins 47, 48, and 49 formed from a flexible polyvinyl chloride and the remaining portions formed from a rigid polyvinyl chloride.

The lip portion 40, the skirt portion 46, and the leg portion 38 of the glazing rim member 36 may be made of a rigid extrusion material and the flexible sealant fins 47, 48, and 49 may be made of a flexible extrusion material.

For example, the glazing rim member 36 may be made of polyvinyl chloride (PVC). More specifically, the glazing rim member 36 may be coextruded from PVC such that the lip portion 40, the skirt portion 46, and the leg portion 38 of the glazing rim member 36 are made of a rigid PVC while the sealant fins 47, 48, and 49 are made of a flexible PVC (e.g., PVC 74±4 Shore A Durometer).

In an assembled position, illustrated in FIG. 3, the leg portion 38 of the glazing rim member 36 is placed in contact with the outer peripheral surface 18 of the flange portion 24 of the second door skin 10 so that a distal end 39 of the leg portion 38 is located in a second notch 23 formed by the outer peripheral surface 18 of the flange portion 24, the distal end 27 of the flange portion 14, and the glazing rim locking tab 52. The glazing rim member 36 is properly oriented relative to the second door skin 20 by the guide rim 15 of the second door skin 20. More specifically, through the application of suitable force, the guide rim 15 is received in the pilot cavity 45 so that the pilot edge 41 of the glazing rim member 36 engages the inner wall 17 of the guide rim 15.

Furthermore, in the assembled position, due to the resilient nature of the material forming the flexible sealant fin 47 of the skirt portion 46, the glazing rim member 36 tightly engages the outer wall 19 of the guide rim 15 of the second door skin 20. Due to the intimate contact between the flexible sealant fin 47 and wall 19, the skirt portion 46 functions as a window seal element. Also, because the material used to form the sealant fins 47, 48, and 49 of the glazing rim member 36 is resilient, the glazing rim member 36 may readily be removed in the event the glass insert 6 should become broken. Thus the glass insert 6 may be replaced without the necessity of replacing the door 2. Furthermore, because the glazing rim member 36 is formed of a resilient material, it forms a tight seal with the glass insert 6. Preferably, door skin 20 is the interior door skin and door skin 10 is the exterior or outside door skin.

As further illustrated in FIG. 3, the glazing rim member 36 is locked in position by snap-locking the distal end 39 of the leg portion 38 thereof in the second notch 23 formed between the outer peripheral surface 18 of the flange portion 24 of the second door skin 20, the glazing rim locking tab 52, and the distal end 27 of the flange portion 14 of the first door skin 10.

The glass insert positioning tab 53 is disposed along the flange portion 14 of the first door skin 10 above the glazing rim locking tab 52. The glass insert positioning tab 53 maintains the glass insert in a predetermined position with respect to the opening in the door 2.

Figure 6A:
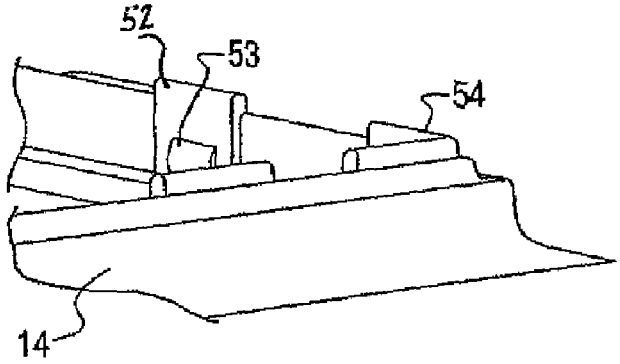
FIGS. 6A through 6C are fragmentary perspective views of positioning tabs on the first door skin depicted around arrows X, Y, and W of FIG. 2A according to the preferred embodiment of the present invention.
Figure 6B:
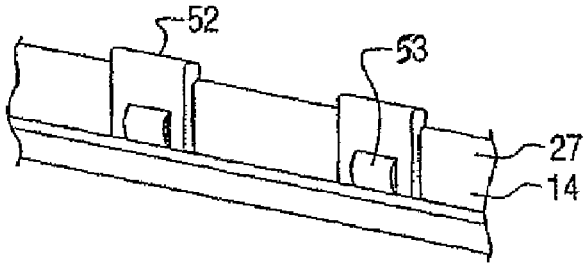
Figure 6C:
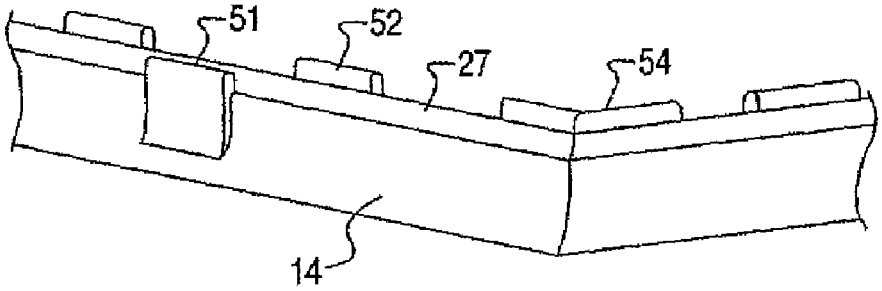

As best shown in FIGS. 6A to 6C, the flange portion 14 includes the skin positioning tabs 51, the glass insert positioning tabs 53, and the glazing rim locking tabs 52 spaced apart from each other in predetermined intervals (i.e., in a discontinuous manner). Furthermore, a corner glazing rim locking tab 54 may be disposed at a corner of the flange portion 14 to lock the glazing rim member 36 in the corners of the opening 11. The corner glass insert positioning tab 54 and the glass insert positioning tab 53 prevent the glass insert 6 from shifting in the opening in the door 2.

The glass insert 6 may be a preassembled two-pane unit or cassette that can be installed readily in the opening during assembly of the door 2. Additionally, due to the strength of assembly of the door 2, laminate glass may be used as the glass insert 6 and the possibility of glass breakage is minimized. The glass insert 6 may be impact resistant.

The procedure of assembling the door 2 with the glass insert 6 according to the preferred embodiment of the present invention will now be described.

First, the first and second door skins 10 and 20 are formed preferably by a compression molding process from any appropriate polymer material, such as fiber glass reinforced SMC. The openings 11, 21 are preferably molded into the door skins 10, 20 in order to reduce material cost and minimize manufacturing costs.

Then, the first and second door skins 10 and 20, the top and bottom rails 7, and the left and right stiles 8 are aligned and attached to each other with adhesive. In this position, the first notch 26 of the flange portion 14 of the first door skin 10 engages the distal end 16 of the flange portion 24 of the second door skin 20 to form a joint and define the cavity 34 (as shown in FIG. 3) between the first and second door skins 10 and 20, respectively. The distal end 16 of the flange portion 24 is maintained in the first notch 26 by the second skin positioning tab 51 and the distal end 27 of the flange portion 14.

Next, the cavity 34 between the first and second door skins 10 and 20 is filled with the expandable foam material 35 which expands within the cavity 34 and may force together the flanges 14 and 24 of the first and second door skins 10 and 20, respectively. The expandable foam may be a polyurethane foam or other foamable material that adds weight to the door 2 and also provides sound and thermal insulation properties.

Preferably, the step of filling the cavity 34 with the foam material 35 is performed while the semi-assembled door 2 is held in an appropriate press (not shown). The semi-assembled door 2 is placed into the press to hold the skins 10, 20 into engagement with the stiles and rails. The press platens may be heated to enhance curing of the adhesive bonding the stiles and rails to the door skins. The press platens have sufficient strength to prevent deflection of the planar plate portions 12, 22 of the door skins 10, 20 during the foaming operation.

The door 2 is then removed from the press. Thereafter, a sealant 100 may be applied to the lip portion 28 of the first door skin 10 in groove 102, as best shown in FIG. 3. The sealant 100 may be a silicone material, caulk, or other material that seals the insert 6 to prevent water from leaking beyond flange 104 and 106 into the interior of the door 2. The glass insert 6 is then inserted through the opening 21 in the second door skin 20 until the glass insert 6 engages the lip portion 28 of the first door skin 10.

Subsequently, the glazing rim member 36 is mounted to the flange portion 24 of the second door skin 20 so that the leg portion 38 of the glazing rim member 36 is angled downward and moved in contact with the outer peripheral surface 18 of the flange portion 24 of the second door skin 20. As noted above, the glazing rim member 36 is properly oriented relative to the first door skin 10 by the guide rim 15 of the second door skin 20 engaging the pilot edge 41 and the skirt portion flexible sealant fin 47 of the glazing rim member 36.

As the glazing rim member 36 is forced into position, the flexible sealant fins 47, 48 and 49 apply a flexible resistance until the pilot edge 41 is moved passed the inner wall 17 of the guide rim 15. At this time, the pilot edge 41 is pushed down along the inner wall 17 such that the guide rim 15 is disposed within the pilot cavity 45. In this position, the glazing rim member 36 is interference fitted to the second door skin 20 and the glass insert 6. Accordingly, the force provided by the flexible sealant fins 47, 48, and 49 push the surface 41 of the glazing rim member 36 into the wall 17 to prevent the glazing rim member 33 from coming out of engagement and prevents the glazing rim member 36 from moving. Also in this position, the flexible sealant fins 47, 48, and 49 may be slightly deformed due to the interference fitting.

Additionally, the glazing rim member 36 is snap-locked into position such that the distal end 39 of the leg portion 38 is secured in the second notch 23 formed between the outer peripheral surface 18 of the flange portion 24, the distal end 27 of the flange portion 14, and the glazing rim member locking tab 52. Also in this position, the lip portion 40 of the glazing rim member 36 is placed against the glass insert 6 laid in the opening of the door 2 on the side opposite to the lip portion 28 of the first door skin 10. This procedure is repeated for each of the glazing rim frame members 36. Thus, the glass insert 6 is locked in place.

We prefer that the door 2 be removed from the press and stored in inventory, so that the appropriate glazing unit 6 may be installed as ordered by consumers.

While we prefer that the flange portion 14 provide a dam, it should be recognized that the expansion of foam 35 could be sufficient to force flange portion 24 upwardly into secure contact of flange portion 14 to further enhance the seal provided by the flange portions. In other words, the flange 24 may be deflected by the expansion force of foam 35.

Also, while we prefer that the core be foam 35, the core could be a wood composite, wood, wood, wood substrate, or foam cement.

The foregoing description of the preferred embodiment of the present invention has been presented for the purpose of illustration in accordance with the provisions of the patent statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A door, comprising:

a glass insert having opposite first and second major surfaces and an outer edge extending between the first and second major surfaces;

a first door skin having a first opening receiving the glass insert, the first door skin comprising a first planar portion, a first flange portion at the first opening extending from the first planar portion substantially parallel to the outer edge of the glass insert, and a first lip portion extending into the first opening to contact the first major surface of the glass insert;

a second door skin having a second opening aligned with the first opening for receiving the glass insert, the second door skin comprising a second planar portion that is spaced from the first planar portion to form a core cavity between the first and second planar portions, a second flange portion at the second opening extending from the second planar portion substantially parallel to the outer edge of the glass insert to contact the first flange portion, and a guide wall comprising a guide rim, the guide wall having an exterior surface generally facing away from the first door skin and angularly disposed relative to the second planar portion and the second flange portion;

a glazing rim member comprising a second lip portion contacting the second major surface of the glass insert, a leg portion disposed on a surface of the second flange portion, and a skirt portion, the leg portion comprising a distal end and an opposite pilot edge, the distal end interlockingly engaged between a glazing rim locking tab of the first door skin and the second flange portion and the pilot edge engaging the guide rim to interference fit the glazing rim member to the second door skin and the glass insert, the skirt portion spaced from the pilot edge to define a pilot cavity that receives the guide rim, the skirt portion applying contact pressure to the exterior surface of the guide wall; and a core material disposed in the core cavity.

2. The door according to claim 1, wherein:

the second lip portion comprises a first flexible sealant fin applying contact pressure to the second major surface of the glass insert; and the skirt portion comprises a second flexible sealant fin applying contact pressure to the exterior surface of the guide wall.

3. The door according to claim 2, wherein the glazing rim member further comprises a third flexible sealant fin disposed between the second lip portion and the leg portion for applying contact pressure to the second major surface of the glass insert.

4. The door according to claim 3, wherein the first, second, and third flexible sealant fins collectively apply flexible resistance to maintain the pilot edge in engagement with the guide rim.

5. The door according to claim 4, wherein the first, second, and third flexible sealant fins are deformed by pressure exerted on the glass insert.

6. The door according to claim 1, wherein said second flange portion extends more than half the width of the core cavity.

7. The door according to claim 1, wherein the guide rim extends from the second flange portion.

8. The door according to claim 1, wherein the first flange portion contains a notch for receiving the distal end of the second flange portion.

9. The door according to claim 1, wherein said core comprises a foam material, wood composite, wood, or foam cement.

10. The door according to claim 1, wherein the second lip portion comprises a plurality of flexible sealant fins applying contact pressure to the second major surface of the glass insert.

11. The door according to claim 10, wherein the glazing rim member further comprises a midsection flexible fin applying contact pressure to the second major surface of the glass insert.

12. The door according to claim 1, wherein the second lip portion and the leg portion of the glazing rim member are formed of a rigid extrusion material, and wherein the glazing rim member further comprises at least one flexible sealant fin formed of a flexible extrusion material.

13. The door according to claim 12, wherein the rigid extrusion material comprises rigid polyvinylchloride and the flexible extrusion material comprises flexible polyvinylchloride.

14. The door according to claim 1, wherein said first flange portion extends normally from said first planar portion, and said second flange portion extends normally from said second planar portion.

15. The door according to claim 1, wherein:

the first planar portion, the first flange portion, and the first lip are integrally formed with one another as a single-piece part; and the second planar portion, the second flange portion, and the second guide wall are integrally formed with one another as a single-piece part.

16. The door according to claim 1, wherein the distal end of the leg portion of said glazing rim member is snap-locked between the second flange portion and the glazing rim locking tab of the first door skin.

17. The door according to claim 1, wherein the core comprises expanded foam deflecting the second flange portion into engagement with the first flange portion.

18. The door according to claim 1, wherein the first lip portion extends from where the first flange portion meets the first planar portion into the first opening.

19. The door according to claim 1, wherein the skirt portion extends from and is formed integrally with the second lip portion.

20. The door according to claim 1, wherein the skirt portion functions as a window seal element.

21. A pre-assembled door adapted for assembly into an assembled state for receiving a glass insert having opposite first and second major surfaces and an outer edge extending between the first major surface and the second major surface, the pre-assembled door comprising:

a first door skin having a first opening for receiving the glass insert, the first door skin comprising a first planar portion, a first flange portion at the first opening extending from the first planar portion, and a first lip portion extending into the first opening for contacting the first major surface of the glass insert;

a second door skin having a second opening that when in the assembled state is aligned with the first opening for receiving the glass insert, the second door skin comprising a second planar portion that when in the assembled state is spaced from the first planar portion to form a core cavity between the first and second planar portions, a second flange portion at the second opening extending from the second planar portion for contacting the first flange portion, and a guide wall comprising a guide rim, the guide wall having an exterior surface generally facing away from the first door skin when in the assembled state and angularly disposed relative to the second planar portion and the second flange portion; and a glazing rim member comprising a second lip portion, a leg portion having a distal end and an opposite pilot edge, and a skiff portion, wherein when in the assembled state the second lip portion contacts the second major surface of the glass insert, the leg portion is disposed on a surface of the second flange portion, the distal end is interlockingly engaged between a glazing rim locking tab of the first door skin and the second flange portion, the pilot edge engages the guide rim to interference fit the glazing rim member to the second door skin and the glass insert, the skirt portion is spaced from the pilot edge to define a pilot cavity that receives the guide rim, and the skirt portion applies contact pressure to the exterior surface of the guide wall.

22. A building component, comprising:

a glass insert having opposite first and second major surfaces and an outer edge extending between the first and second major surfaces;

a first building component skin having a first opening receiving the glass insert, the first building component skin comprising a first planar portion, a first flange portion at the first opening extending from the first planar portion substantially parallel to the outer edge of the glass insert, and a first lip portion extending into the first opening to contact the first major surface of the glass insert;

a second building component skin having a second opening aligned with the first opening for receiving the glass insert, the second building component skin comprising a second planar portion that is spaced from the first planar portion to form a core cavity between the first and second planar portions, a second flange portion at the second opening extending from the second planar portion substantially parallel to the outer edge of the glass insert to contact the first flange portion, and a guide wall comprising a guide rim, the guide wall having an exterior surface generally facing away from the first building component skin and angularly disposed relative to the second planar portion and the second flange portion; and a glazing rim member comprising a second lip portion contacting the second major surface of the glass insert, a leg portion disposed on a surface of the second flange portion, and a skirt portion, the leg portion comprising a distal end and an opposite pilot edge, the distal end interlockingly engaged between a glazing rim locking tab of the first building component skin and the second flange portion and the pilot edge engaging the guide rim to interference fit the glazing rim member to the second building component and the glass insert, the skirt portion spaced from the pilot edge to define a pilot cavity that receives the guide rim, the skirt portion applying contact pressure to the exterior surface of the guide wall.

23. A method for assembling a door, said method comprising:

providing a partially constructed door comprising a glass insert having opposite first and second major surfaces and an outer edge extending between the first and second major surfaces;

a first door skin having a first opening receiving the glass insert, the first door skin comprising a first planar portion, a first flange portion at the first opening extending from the first planar portion substantially parallel to the outer edge of the glass insert, and a first up portion extending into the first opening to contact the first major surface of the glass insert; and a second door skin having a second opening aligned with the first opening for receiving the glass insert, the second door skin comprising a second planar portion that is spaced from the first planar portion to form a core cavity between the first and second planar portions, a second flange portion at the second opening extending from the second planar portion substantially parallel to the outer edge of the glass insert to contact the first flange portion, and a guide wall comprising a guide rim, the guide wall having an exterior surface generally facing away from the first door skin and angularly disposed relative to the second planar portion and the second flange portion; and mounting a glazing rim member on the partially constructed door, the glazing rim member in a mounted state comprising a second lip portion contacting the second major surface of the glass insert, a leg portion disposed on a surface of the second flange portion, and a skirt portion, the leg portion comprising a distal end and an opposite pilot edge, the distal end interlockingly engaged between a glazing rim locking tab of the first door skin and the second flange portion and the pilot edge engaging the guide rim to interference fit the glazing rim member to the second door skin and the glass insert, the skirt portion spaced from the pilot edge to define a pilot cavity that receives the guide rim, the skirt portion applying contact pressure to the exterior surface of the guide wall.

* * * * *